United States Patent [19]

Valarao

[11] Patent Number: 4,583,250

[45] Date of Patent: Apr. 22, 1986

[54] DEVICE FOR THE REMOVAL OF FOUL AIR FROM TOILET BOWLS

[76] Inventor: Bonifacio C. Valarao, 107 Park St., Apt. C, Alhambra, Calif. 91801

[21] Appl. No.: 772,326

[22] Filed: Sep. 4, 1985

Related U.S. Application Data

[63] Continuation-in-part of Ser. No. 612,847, May 22, 1984, abandoned.

[51] Int. Cl.[4] ..... E03D 9/04

[52] U.S. Cl. ..... 4/213; 4/209 R

[58] Field of Search ..... 4/213, 217, 209 R, 216, 4/347, 472, 475, 477, 482

[56] References Cited

U.S. PATENT DOCUMENTS

| | | | |
|---|---|---|---|
| 2,100,962 | 11/1937 | Juntunen | 4/213 |
| 2,105,794 | 1/1938 | Norris | 4/213 |
| 2,227,920 | 1/1941 | Baither | 4/213 |
| 2,279,789 | 4/1942 | Jentzer | 4/213 |
| 2,881,450 | 4/1959 | Tubbs | 4/213 X |
| 2,985,890 | 5/1961 | Baither | 4/213 |
| 3,691,568 | 9/1972 | Martz | 4/213 |
| 3,763,505 | 10/1973 | Zimmerman | 4/213 |
| 3,781,923 | 1/1974 | Maisch et al. | 4/213 |
| 4,165,544 | 8/1979 | Barry | 4/213 |

*Primary Examiner*—Henry K. Artis

*Attorney, Agent, or Firm*—Christie, Parker & Hale

[57] ABSTRACT

This invention is an amendment of patent application Ser. No. 06/612,847 filed May 22, 1984 relating to the method of extracting objectional odors from toilet bowls utilizing its present structures and installation. A powered exhaust fan attached directly above are designed overflow tube will suck the foul air from the bowl through the water outlets under the rim of the toilet seat; through the flush valve assembly; into the overflow tube and forcing the same air through twin charcoal filters incorporated into the odor extracting device. Emphasis of the instant invention is on the design of the water tank overflow tube which is critical to the effectiveness of an odor extracting device. The redesigned overflow tube, while retaining the function of the conventional overflow tube, will allow for the recycling of previously filtered air. Also, the fan motor in the instant invention is so constructed that easy access to the interior of the odor extracting device is facilitated. Since no other modification of the toilet bowl and tank is required, this system is practical, simple and economical to use on existing and future toilet bowl designs.

6 Claims, 5 Drawing Figures

DEVICE FOR THE REMOVAL OF FOUL AIR FROM TOILET BOWLS

CROSS-REFERENCE TO RELATED APPLICATIONS

This application is a continuation-in-part application of U.S. patent application Ser. No. 612,847 filed May 22, 1984 and entitled "The Valarao Device for the Removal of Foul Air from Toilet Bowls", now abandoned.

FIELD OF THE INVENTION

This invention relates to a device for extracting objectionable odors from toilet bowls.

BACKGROUND OF THE INVENTION

Various odor extracting devices in combination with the toilet per se have been described in the prior art. Most of the systems described involve either drastic modifications on the toilet bowl or the installation of complicated power ventilation systems communicating with the sewage piping system. The majority of the structures are not readily attachable to the existing toilet bowl installation and are not provided with adequate controls against the sewer and gas backups. Further, many devices heretofor found in the prior art do not provide for recirculation and hence blower or fan overheating can occur.

SUMMARY OF THE INVENTION

There is, therefore, provided in the practice of the present invention, a device and system for a toilet or water closet which is easily installed on a conventional water closet without requiring modifications thereto, which provides for recirculation of ventilated air to prevent the fan from overheating and which is adaptable to many water tank component configurations.

Toward this end, the device is adapted to be used with a water closet of the type having a bowl with a rim, a water tank with a cover and a passageway providing communication between the tank and bowl. The passageway communicates with the bowl through a plurality of openings at the bowl rim to provide for a downward cascade when the toilet is flushed. Valve means are provided within the tank for opening and closing the passageway for flushing the toilet into a sewer pipe and for interchanging the water in the bowl. An overflow pipe disposed in the tank drains into the passageway and sewer pipe should the tank be overfilled. The device for use with this conventional water closet includes a power exhaust structure attachable to the water tan top between the tank and its cover. The structure includes a lower lip adapted to seal against the top of the water closet tank terminating opposite the lip at an upper border adapted to sealingly mate with the tank cover. A barrier wall is disposed in the housing to define, in combination with the cover, a closed chamber separated from the interior of the tank by the partition. The barrier wall includes a bore aligned closely about the overflow pipe for the water tank and filter means to pass air from the chamber into the tank while filtering orders therefrom. A portion of the air circulated through the filter means recirculates back to the bore to continuously provide the fan with a supply of air for cooling thereof. The filtered air not recirculating back to the fan is discharged from the structure to atmosphere through an opening preferably embodied as an undercut in the structure's lip.

To provide for arranging the overflow pipe closely adjacent the bore and fan an adjustable adapter is provided which slips over the overflow pipe. Opposite the overflow pipe, the adapter telescopes to be closely arranged relative to the bore and fan to direct air from the passageway and overflow pipe to the fan. The adapter further includes a telescopic dip leg. When the water tank is filled with water the dip leg is submerged whereby said fan draws odors from the passageway through the overflow pipe and adapter for filtering odors therefrom. When the toilet is flused, the water is directed through the passageway to the toilet bowl, the water level on the tank dropping. In that the passageway will be blocked by water, when the water in the tank drops below the dip leg air within the tank is supplied through the dip leg and adapter to the fan making sure that the fan has a continuous supply of circulating air.

BRIEF DESCRIPTION OF THE DRAWINGS

These and other features and advantages of the present invention will become appreciated as the same becomes better understood with reference to the specification, claims and drawings wherein:

DETAILED DESCRIPTION

Figure 1:
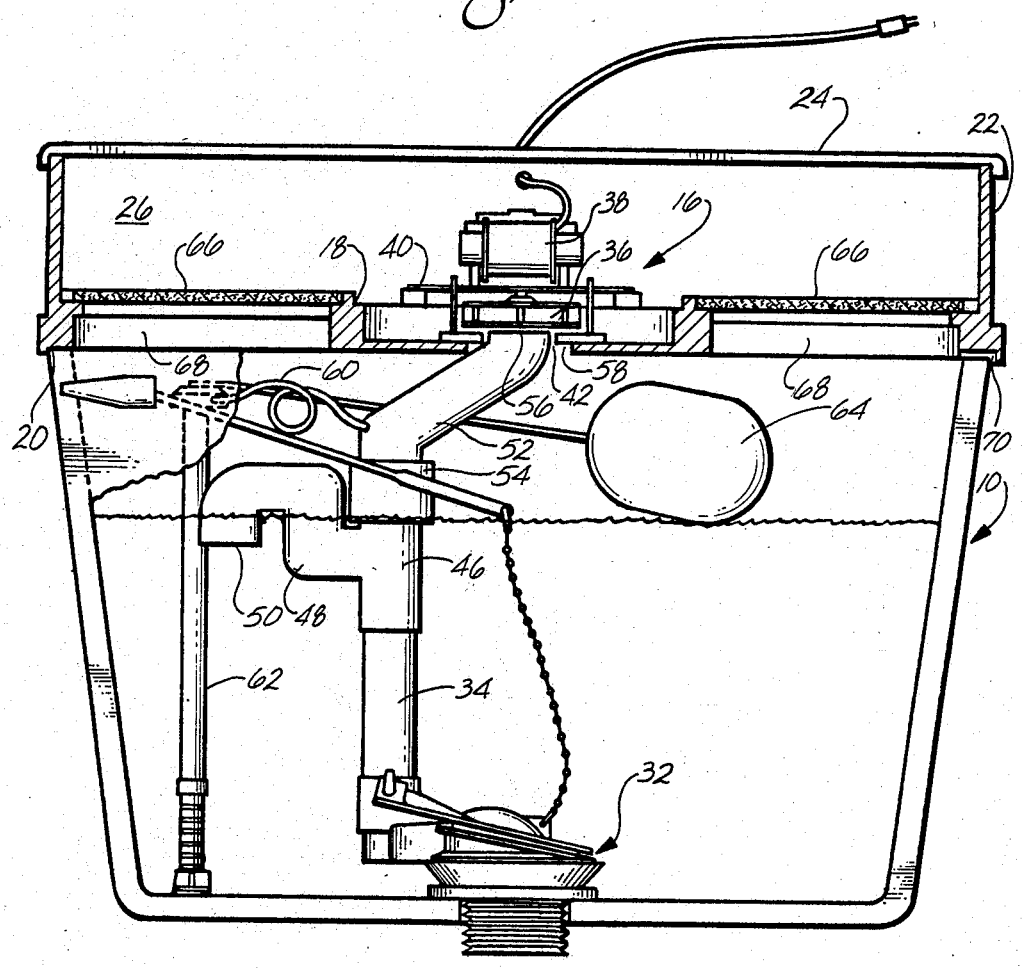
FIG. 1 is a cross-section view of the water closet tank and of the device according to one embodiment of the invention.
Figure 2:
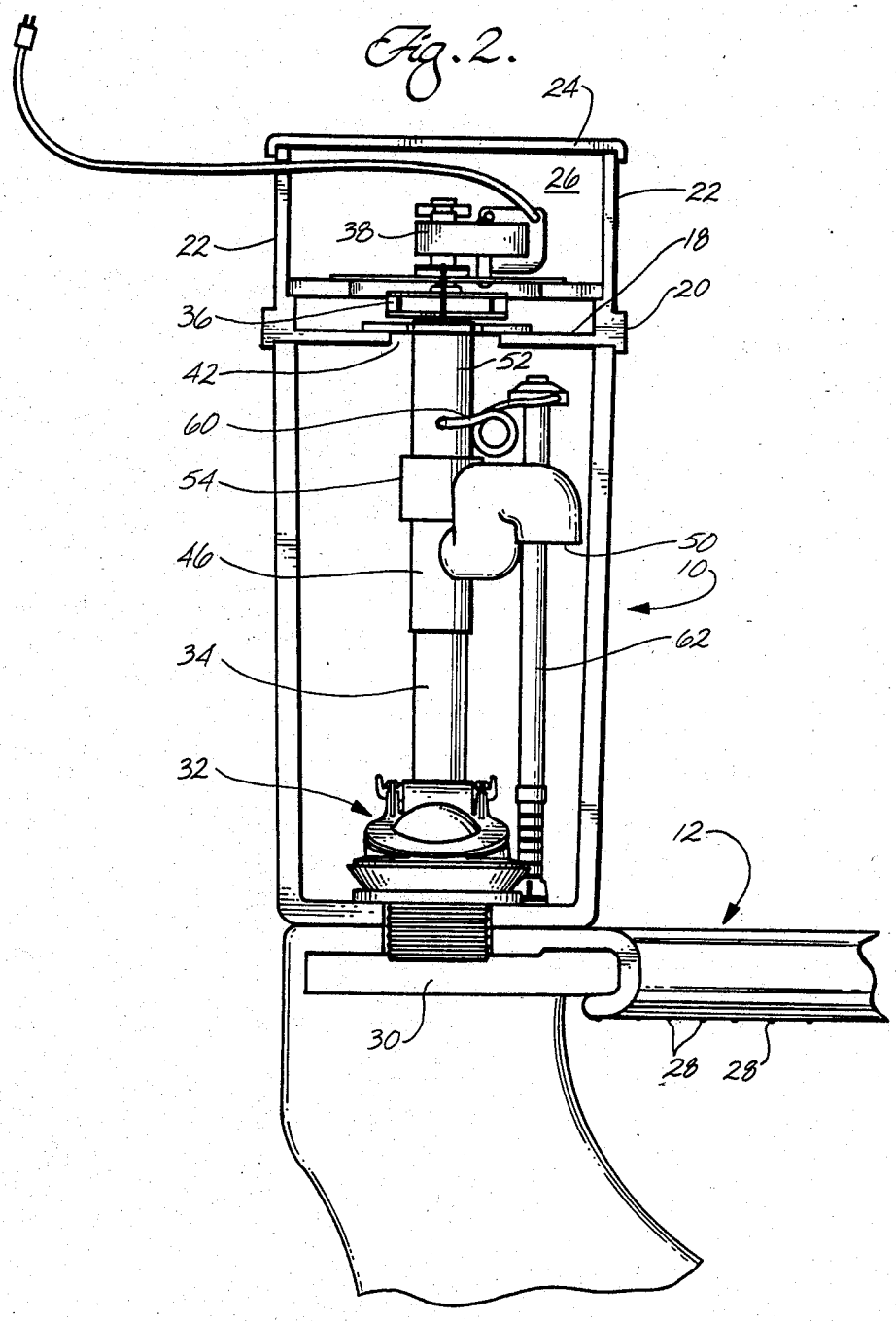
FIG. 2 is a side section view of the water closet and tank and device of FIG. 1.

Referring now in detail to the drawings, FIGS. 1 and 2 illustrate a conventional toilet including a water tank 10 and toilet bowl 12 which incorporates one embodiment of a device 16 according to the present invention. As best shown in FIG. 1, the device 16 is adapted to be placed on top of the water tank 10 and is molded to include a bottom barrier wall 18 the periphery of which has a lip 20 adapted to closely mate with the top of the tank 10. Upstanding side walls 22 extend from the barrier wall 18 to an upper extremity to receive the tank top 24 and cooperate with the barrier wall 18 to define a generally closed upper chamber 26. The top 24 is preferably the conventional porcelain top found in most toilets having tanks 10.

The toilet bowl 12 includes a plurality of seat rim holes 28 disposed under the rim of the seat of the toilet bowl 12 which communicate with a lower chamber 30. Lower chamber 30 communicates in turn with the tank 10 through a flush valve assembly 32 and is vented by a conventional overflow tube 34. When the flush valve assembly 32 is opened during the flushing operation, water from the tank 10 drains through the open of flush valve assembly into the lower chamber 30 and through the toilet seat rim holes 28 into the bowl 12. In all other conditions, i.e., when the toilt is not being flushed, the holes 28 communicate via the lower chamber 30 and overflow the tube 34 directly into the tank 10. The device 16 according to the present invention is adapted to take advantage of this communication between the bowl 12 and tank 10 provided by the equipment already in place to remove foul odors therefrom.

Figure 3:
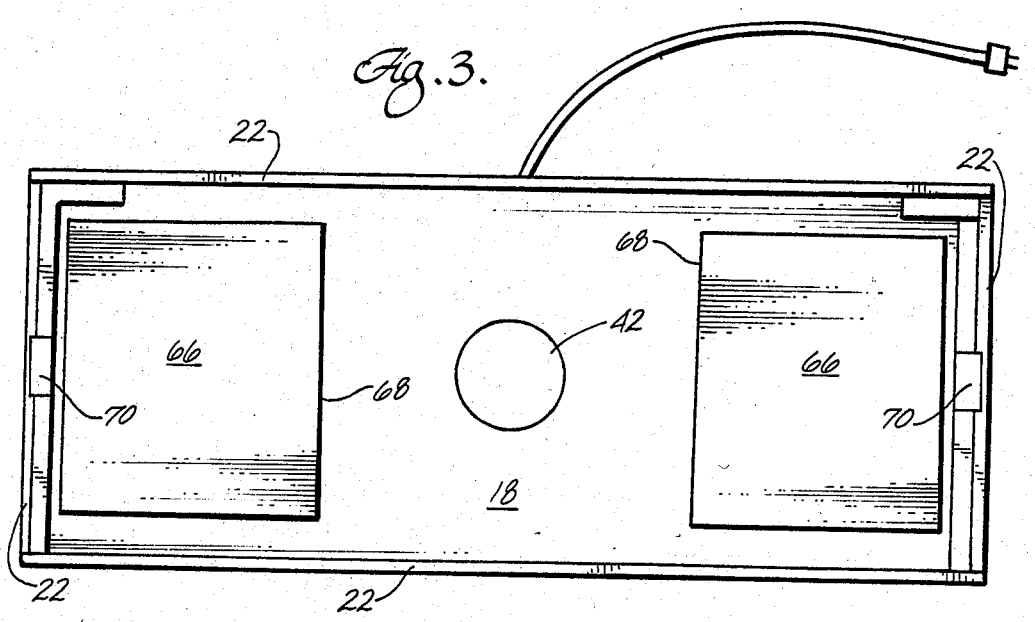
FIG. 3 is a bottom view of the device according to the embodiment of FIG. 1.

The device 16 according to the embodiment shown in FIGS. 1–3, includes an exhaust fan 36 powered by an electric motor 38. The motor 38 is connected to a power source of 110 volts A/C which may be actuated either by a light switch or by a separate switch perhaps provided on the tank 10 or side walls 22. To support the fan 36 and motor 38, a fan support base 40 is provided to orient the motor 38 and fan 36 as to draw air through an opening 42 provided centrally in the barrier wall 18 as best shown in FIG. 3. When the fan motor 38 is energized, the fan 36 draws air from the tank 10 discharging it into the upper chamber 26. The relatively lower pressure in the tank 10 draws foul air from the toilet bowl 12 into the holes 28, lower chamber 30, up the overflow tube 34 and into the tank 10. The odorous air is then delivered by the fan into the upper chamber 26 to be purified and discharged from the device 16 as described hereinafter.

To maintain the above described air flow from the toilet bowl into the tank 10, the device 16 according to the present invention, as shown in FIGS. 1 and 2 includes an overflow tube adapter 44 which connects over the overflow tube 34 for the toilet flushing means. Adapter 44 includes a sleeve portion 46 which fits over the overflow tube 34 and further includes a portion defining a dip pipe 48 connected as a T to the sleeve portion 46. Dip pipe 48 has a C-shape terminating at a vent end 50 which, relative to the sleeve portion 46 is located medially. Coupled to the sleeve portion 46 is a suction tube 52 which acts to extend the overflow tube to vent to a location proximate the fan 36 as best shown in FIG. 1. Accordingly, the suction tube 52 is attached by a coupling 54 to the sleeve portion 46 and, opposite the coupling 44, includes an end 56 located through the opening 42 near the fan 36. As can be appreciated from FIG. 1, the suction tube 52 has a diameter smaller than the opening 42 to provide an open annulus 58 thereabout. To accomodate different styles of toilet flushing means, the suction tube 52 can have various configurations and lengths so as to locate its end 56 in the desired manner. A refill tube 60 is coupled between the suction tube 52 and water supply 62 for refilling of the tank 10. In a conventional manner, a float 64 controls the water supply 62.

In operation, the motor 38 is operated to cause the fan 36 to create a pressure differential between the tank 10 and the upper chamber 26 and toilet bowl 12. The foul air drawn from the toilet bowl up to the overflow tube 34 and through the adapter 44 is discharged into the upper chamber 26. The pressure differential between the upper chamber 26 at a higher pressure and the tank 10 at a lower pressure causes the foul air within the upper chamber 26 to be driven through at least one and preferably a pair of pourous filters 66 mounted and supported by the barrier wall 18. Apertures 68 are associated with the filters 66 to permit the air to pass through the barrier wall 18. Preferably, the filters 66 are of a charcoal type. The foul air discharged into the upper chamber 26 passes through the filters 66 which trap most if not all of the odorous vapors. In that the filters 66 are aranged closely to the water contained in the tank 10, the humidity provided thereby enhances the filtering action of the filters 66. The purified air after having passed through the filters 66 is discharged back into the tank 10. A portion of the filtered air passes from the device through an undercut 70 (FIG. 1) provided at one or both sides of the device 16. As shown, the undercut is made cooperatively at the lip 20 and side walls 22 for discharging of the purified air into the atmosphere. The remaining portion of the purified air within the tank is recirculated through the annulus 58 back to the fan 36. The continuous recirculation of purified air with the air supplied directly from the toilet bowl 12 is believed to enhance the filtering action of the device 16 in that a constant supply of air is provided to the fan 36. Further, the circulation of air is believed to enhance the life of the fan motor 38 since recirculation means that the fan will always have an adequate supply of suction air for cooling of the motor 38.

During the flushing operation, when the flush valve assembly 32 is open, a surge of water will block the overflow tube 34 as water is supplied to the toilet bowl. The water passing from the tank 10 through the lower chamber 30 blocks the supply of air from the toilet bowl 12. To provide a constant supply of air to the fan 36, as the water level in the tank 10 drops, the dip pipe 48 and more particularly its vent end 50 conveniently becomes exposed so that air within the tank 10 can be drawn therethorugh to the suction tube 52 and to the fan 36. Accordingly, even during flushing a constant supply of air is provided to the fan for recirculation thereof. When the tank is refilled with water and the level rises so as to submerge the vent end 50, suction air again becomes drawn through the holes 28 at the toilet bowl 12.

The foregoing operation of the device 16 continues until the device is turned off.

Figure 4:
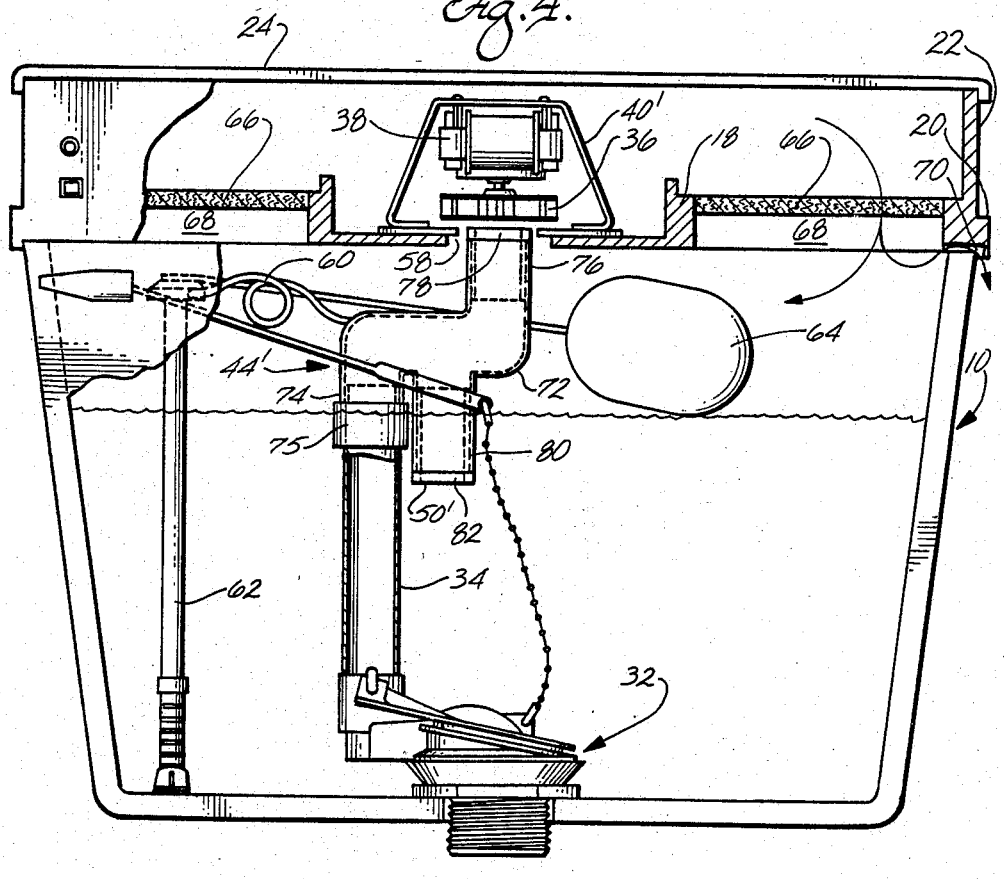
FIG. 4 is a front section view of yet another embodiment of the device according to the present invention shown mounted on a water closet tank.
Figure 5:
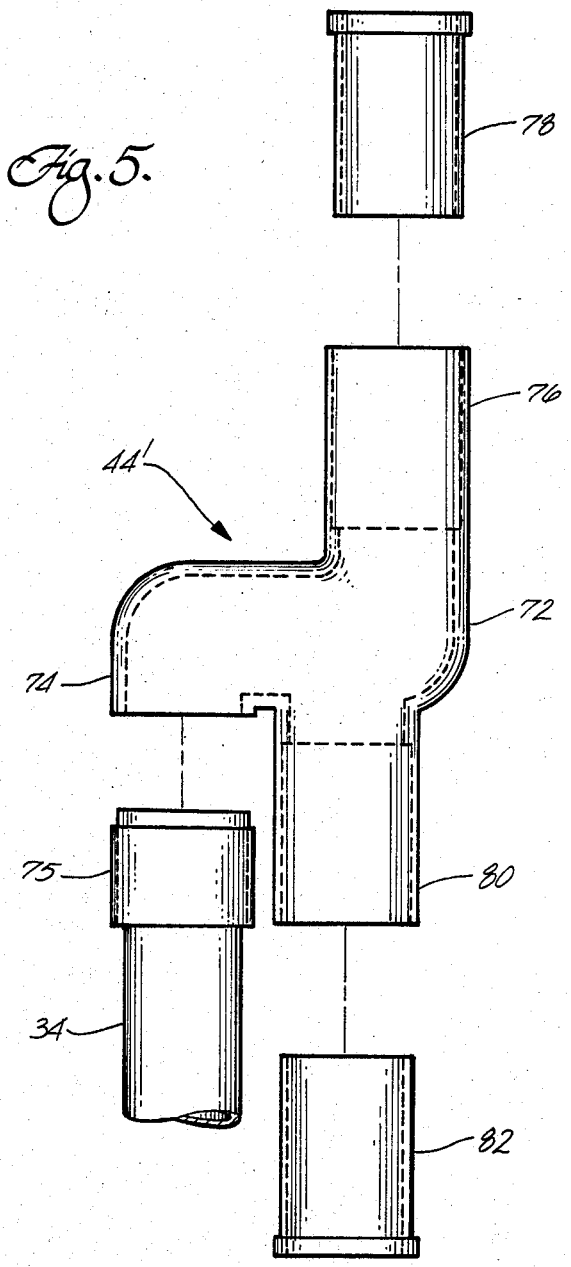
FIG. 5 is an exploded view of an adapter for use with the device shown in FIG. 4.

Turning to FIGS. 4 and 5, a further embodiment of the device is shown in detail. Similar parts will carry the same reference numeral.

The device 16 according to FIGS. 4 and 5, includes a modified base 40' adapted to suspend the motor 38 and fan 36 over the opening 42.

To provide communication between the overflow tube 34 and the fan 36 and approved adapter 44' is provided. The adapter 44' is adjustable to accomodate different configurations and locations of overflow tubes and hence can easily be fitted to various styles of toilets. The adapter 44' includes an S-tube 72 having one end 74 adapted to be closely fitted over the upper end of the overflow tube 34. The other end 76 of the S-tube 72 accommodates a first telescopic member 78. As best shown in FIG. 5, the one end 74 is coupled to the overflow tube via a coupling 75 which permits orientation of the S-tube 72 in a desired fashion. By providing the first telescopic member 78 should the configuration of the overflow tube 34 be such that the other end 76 positioned remote from the fan, the first telescopic member 78 may be positioned relative to the other end 78 so as to effectively extend S-tube 72 to a location proximate the fan 36. In this manner, the fan 36 can efficiently draw foul air from the toilet bowl as described above.

To provide a continuous supply of air to the fan 36, even during the flushing operation, the adapter 44' further includes a dip leg 80 projecting downwardly from the S-tube 72 parallel to the overflow tube 34. The dip leg 80 accommodates a second telescopic member 82 having a vent end 50'. For proper operation of the adapter 44', the second telescopic member 82 can be positioned relative to the dip leg 80 so as to contact and become submerged and sealed within the water contained in the tank 10 during most instances and when the toilet is flushed become open to provide a constant supply of air to the fan 36.

While I have shown and described certain embodiments of the present invention, it is to be understood that it is subject to many modifications without departing from the spirit and scope of the invention as set forth in the appended claims:

What is claimed is:

1. A ventilation system for a toilet of the type having a bowl, with a rim, a water tank with a top, a passageway providing communication between the tank and bowl, valve means for opening and closing said passageway for flushing the water closet into a sewer pipe and an overflow pipe disposed in the tank to drain into said passageway and sewer pipe when the tank is overfilled, the system comprising:

a device disposed between the tank and cover, the device including a housing having a lower lip adapted to seal against the top of the tank and upstanding walls to sealingly support the tank top;

a barrier wall disposed in the housing defining in combination with the top a closed upper chamber, said barrier wall including an opening and said lower lip including at least one aperture disposed beneath the barrier wall to provide communication between the tank and atmosphere;

means for adapting the overflow tube to extend to a position subadjacent said opening, the adapting means also defining in cooperation with the opening an annulus, said overflow communicating with said passageway;

a fan disposed in said chamber at said opening to draw foul air from said bowl and passageway through the overflow pipe and from the tank through said annulus and discharge the air to said chamber, said fan creating a pressure differential between said chamber and said tank;

filter means at said barrier wall to entrap odors, said pressure differential causing the air in the chamber to pass through the filter means for entrapment of odors and into said tank, a portion of the filtered air entering the tank discharged from the device at said aperture and the remainder recirculated to the annulus to combine with the foul air drawn from said overflow pipe.

2. The system of claim 1 wherein the adapting means includes an adapter having a sleeve portion to sealingly fit over the upper end of the overflow tube, a suction tube attached to the overflow tube and positioned by a coupling, the suction tube having an end adapted to be disposed in said opening, the adapter further including a C-shaped dip pipe coupled to the sleeve portion and having a downwardly directed vent end positioned to be submerged in the water in the tank, when the toilet is flushed and said passageway is flooded with water, said vent end is uncovered to provide air through said sleeve portion and suction tube to said fan.

3. The system of claim 2 wherein the adapter includes at the suction tube end a first member telescopically positionable to a location proximate the fan.

4. The system of claim 2 wherein the adapter includes at the vent end a second member telescopically positionable for submergence at different tank water levels.

5. The system of claim 2 wherein the adapter includes at the suction tube end a first member telescopically positionable to a location proximate the fan and the vent end includes a second member telescopically positionable for submergence at differente tank water levels.

6. The system of claim 1 wherein the filter means includes at least one activated charcoal filter horizontally arranged at the barrier wall.

* * * * *